US010244339B2

(12) United States Patent
Kropp et al.

(10) Patent No.: US 10,244,339 B2
(45) Date of Patent: Mar. 26, 2019

(54) METHOD AND APPARATUS FOR HIGHER ORDER AMBISONICS ENCODING AND DECODING USING SINGULAR VALUE DECOMPOSITION

(71) Applicant: Dolby International AB, Amsterdam Zuidoost (NL)

(72) Inventors: Holger Kropp, Wedemark (DE); Stefan Abeling, Schwarmstedt (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/676,843

(22) Filed: Aug. 14, 2017

(65) Prior Publication Data

US 2017/0374485 A1 Dec. 28, 2017

Related U.S. Application Data

(63) Continuation of application No. 15/039,887, filed as application No. PCT/EP2014/074903 on Nov. 18, 2014, now Pat. No. 9,736,608.

(30) Foreign Application Priority Data

Nov. 28, 2013 (EP) ..... 13306629

(51) Int. Cl.
*H04S 3/00* (2006.01)
*H04S 3/02* (2006.01)
(Continued)

(52) U.S. Cl.
CPC ..... *H04S 3/02* (2013.01); *H04S 3/008* (2013.01); *H04S 7/308* (2013.01); *G10L 19/008* (2013.01); *H04S 2420/11* (2013.01)

(58) Field of Classification Search
CPC . H04S 3/02; H04S 7/308; H04S 3/008; H04S 2420/11; H04S 5/005; H04S 7/30; G10L 19/008
(Continued)

(56) References Cited

U.S. PATENT DOCUMENTS

2010/0098274 A1 4/2010 Hannemann
2011/0261973 A1 10/2011 Nelson
(Continued)

FOREIGN PATENT DOCUMENTS

EP 2645748 10/2013
EP 2665208 11/2013
(Continued)

OTHER PUBLICATIONS

Boehm et al., "RMO-HOA Working Draft Text", International Organisation for Standards, ISO/IEC JTC/SC29/WG11, Coding of Moving Pictures and Audio, Geneva, Switzerland, Oct. 2013, pp. 1-76.

(Continued)

*Primary Examiner* — Yogeshkumar Patel

(57) ABSTRACT

The encoding and decoding of HOA signals using Singular Value Decomposition includes forming based on sound source direction values and an Ambisonics order corresponding ket vectors ($|Y(\Omega_s)\rangle$) of spherical harmonics and an encoder mode matrix ($\Xi_{O\times S}$). From the audio input signal ($|x(\Omega_s)\rangle$) a singular threshold value ($\sigma_S$) determined. On the encoder mode matrix a Singular Value Decomposition is carried out in order to get related singular values which are compared with the threshold value, leading to a final encoder mode matrix rank ($r_{fin_s}$). Based on direction values ($\Omega_l$) of loudspeakers and a decoder Ambisonics order ($N_l$), corresponding ket vectors ($|Y(\Omega_l)\rangle$) and a decoder mode matrix ($\Psi_{O\times L}$) are formed. On the decoder mode matrix a Singular (Continued)

Value Decomposition is carried out, providing a final decoder mode matrix rank ($r_{fin_d}$). From the final encoder and decoder mode matrix ranks a final mode matrix rank is determined, and from this final mode matrix rank and the encoder side Singular Value Decomposition an adjoint pseudo inverse $(\Xi^{+})^{\dagger}$ of the encoder mode matrix ($\Xi_{O\times S}$) and an Ambisonics ket vector ($|a'_s\rangle$) are calculated. The number of components of the Ambisonics ket vector is reduced according to the final mode matrix rank so as to provide an adapted Ambisonics ket vector ($|a'_l\rangle$). From the adapted Ambisonics ket vector, the output values of the decoder side Singular Value Decomposition and the final mode matrix rank an adjoint decoder mode matrix $(\Psi)^{\dagger}$ is calculated, resulting in a ket vector ($|y(\Omega_l)\rangle$) of output signals for all loudspeakers.

9 Claims, 6 Drawing Sheets

(51) Int. Cl.
*H04S 7/00* (2006.01)
*G10L 19/008* (2013.01)

(58) Field of Classification Search
USPC ..... 704/500, 222; 381/23, 22, 17, 307
See application file for complete search history.

(56) References Cited

U.S. PATENT DOCUMENTS

2014/0247946 A1* 9/2014 Sen ..... G10L 19/008 381/23
2015/0098572 A1* 4/2015 Krueger ..... G10L 19/008 381/22
2015/0163615 A1* 6/2015 Boehm ..... H04S 3/008 381/1

FOREIGN PATENT DOCUMENTS

EP 2688066 1/2014
JP H06-202700 7/1994
JP 2008-535015 8/2008
JP 2008-542807 11/2008
JP 2010-525403 7/2010
JP 2013-507796 3/2013
WO 2005/015954 2/2005
WO 2012/023864 2/2012
WO WO-2013171083 A1 * 11/2013 ..... G10L 19/008
WO 2014/012945 1/2014
WO WO-2014012945 A1 * 1/2014 ..... H04S 3/008

OTHER PUBLICATIONS

Fazi et al., "Surround system based on three dimensional sound field reconstruction", Audio Engineering Society Convention Paper 7555, San Francisco, California, USA, Oct. 2, 2008, pp. 1-22.
Fazi et al., "The ill-conditioning problem in Sound Field Reconstruction", Audio Engineering Society Convention Paper 7244, New York, New York, USA, Oct. 5, 2007, pp. 1-12.
Golub et al., "Matrix Computations", Third Edition, The Johns Hopkins University Press, Baltimore, 1996, pp. 1-723.
Hansen, "Rank-Deficient and Discrete III-Posed Problems: Numerical Aspects of Linear Inversion", Mathematical Modeling and Computation Series, Technical University of Denmark, Lyngby, Denmark, 1998, pp. 1-6, Abstract of Book.
Poletti, M., "A Spherical Harmonic Approach to 3D Surround Sound Systems", Forum Acusticum 2005, Budapest, Hungary, 2005, pp. 311-317.
Trevino et al., "High order Ambisonic decoding method for irregular loudspeaker arrays", 20th International Congress on Acoustics, Sydney, Australia, Aug. 23-27, 2010, pp. 1-8.
Wabnitz et all., "Time Domain Reconstruction of Spatial Sound Fields using Compressed Sensing", 2011 IEEE International Conference on Acoustics, Speech and Signal Processing (ICASSP), Prague, Czech Republic, May 22, 2011, pp. 465-468.
U.S. Appl. No. 61/771,677, filed Mar. 1, 2013, Dipanjan, et al.
U.S. Appl. No. 61/860,201, filed Jul. 30, 2013, Morrell, et al.

* cited by examiner

METHOD AND APPARATUS FOR HIGHER ORDER AMBISONICS ENCODING AND DECODING USING SINGULAR VALUE DECOMPOSITION

TECHNICAL FIELD

The invention relates to a method and to an apparatus for Higher Order Ambisonics encoding and decoding using Singular Value Decomposition.

BACKGROUND

Higher Order Ambisonics (HOA) represents three-dimensional sound. Other techniques are wave field synthesis (WFS) or channel based approaches like 22.2. In contrast to channel based methods, however, the HOA representation offers the advantage of being independent of a specific loudspeaker set-up. But this flexibility is at the expense of a decoding process which is required for the playback of the HOA representation on a particular loudspeaker set-up. Compared to the WFS approach, where the number of required loudspeakers is usually very large, HOA may also be rendered to set-ups consisting of only few loudspeakers. A further advantage of HOA is that the same representation can also be employed without any modification for binaural rendering to head-phones.

HOA is based on the representation of the spatial density of complex harmonic plane wave amplitudes by a truncated Spherical Harmonics (SH) expansion. Each expansion coefficient is a function of angular frequency, which can be equivalently represented by a time domain function. Hence, without loss of generality, the complete HOA sound field representation actually can be assumed to consist of O time domain functions, where O denotes the number of expansion coefficients. These time domain functions will be equivalently referred to as HOA coefficient sequences or as HOA channels in the following. An HOA representation can be expressed as a temporal sequence of HOA data frames containing HOA coefficients. The spatial resolution of the HOA representation improves with a growing maximum order N of the expansion. For the 3D case, the number of expansion coefficients O grows quadratically with the order N, in particular $O=(N+1)^2$.

Complex Vector Space

Ambisonics have to deal with complex functions. Therefore a notation is introduced which is based on complex vector spaces. It operates with abstract complex vectors, which do not represent real geometrical vectors known from the three-dimensional 'xyz' coordinate system. Instead, each complex vector describes a possible state of a physical system and is formed by column vectors in a d-dimensional space with d components $x_i$ and—according to Dirac—these column-oriented vectors are called ket vectors denoted as $|x\rangle$. In a d-dimensional space, an arbitrary $|x\rangle$ is formed by its components $x_i$ and d orthonormal basis vectors $|e_i\rangle$:

$$|x\rangle = x_1|e_1\rangle + x_2|e_2\rangle + \ldots + x_d|e_d\rangle = \sum_{i=1}^{d} x_i|e_i\rangle. \tag{1}$$

Here, that d-dimensional space is not the normal 'xyz' 3D space.

The conjugate complex of a ket vector is called bra vector $|x\rangle^* = \langle x|$. Bra vectors represent a row-based description and form the dual space of the original ket space, the bra space.

This Dirac notation will be used in the following description for an Ambisonics related audio system.

The inner product can be built from a bra and a ket vector of the same dimension resulting in a complex scalar value. If a random vector $|x\rangle$ is described by its components in an orthonormal vector basis, the specific component for a specific base, i.e. the projection of $|x\rangle$ onto $|e_i\rangle$, is given by the inner product:

$$x_i = \langle x||e_i\rangle = \langle x|e_i\rangle. \tag{2}$$

Only one bar instead of two bars is considered between the bra and the ket vector.

For different vectors $|x\rangle$ and $|y\rangle$ in the same basis, the inner product is got by multiplying the bra $\langle x|$ with the ket of $|y\rangle$, so that:

$$\langle x \mid y\rangle = \sum_{i=1}^{d} \left\langle x_i e_i \middle| \cdot \sum_{j=1}^{d} y_j \middle| e_j \right\rangle = \sum_{i,j=1}^{d} x_i^* y_j \langle e_i \mid e_j\rangle = \sum_{i,j=1}^{d} x_i^* y_j = \sum_{i,j=1}^{d} y_i^* x_i.$$

If a ket of dimension m×1 and a bra vector of dimension 1×n are multiplied by an outer product, a matrix A with m rows and n columns is derived:

$$A = |x\rangle\langle y| \tag{4}$$

Ambisonics Matrices

An Ambisonics-based description considers the dependencies required for mapping a complete sound field into time-variant matrices. In Higher Order Ambisonics (HOA) encoding or decoding matrices, the number of rows (columns) is related to specific directions from the sound source or the sound sink.

At encoder side, a variant number of S sound sources are considered, where s=1, . . . , S. Each sound source s can have an individual distance $r_s$ from the origin, an individual direction $\Omega_s=(\Theta_s, \Phi_s)$, where $\Theta_s$ describes the inclination angle starting from the z-axis and $\Phi_s$ describes the azimuth angle starting from the x-axis. The corresponding time dependent signal $x_s=(t)$ has individual time behaviour.

For simplicity, only the directional part is considered (the radial dependency would be described by Bessel functions). Then a specific direction $\Omega_s$ is described by the column vector $|Y_n^m(\Omega_s)\rangle$, where n represents the Ambisonics degree and m is the index of the Ambisonics order N. The corresponding values are running from m=1, . . . , N and n=−m, . . . , O, . . . , m, respectively.

In general, the specific HOA description restricts the number of components O for each ket vector $|Y_n^m(\Omega_s)\rangle$ in the 2D or 3D case depending on N:

$$O = \begin{cases} 2N+1, & 2D \\ (N+1)^2, & 3D \end{cases}. \tag{5}$$

For more than one sound source, all directions are included if s individual vectors $|Y_n^m(\Omega_s)\rangle$ of order n are combined. This leads to a mode matrix Ξ, containing O×S mode components, i.e. each column of Ξ represents a specific direction:

$$\Xi = \begin{bmatrix} Y_0^0(\Omega_1) & \dots & Y_0^0(\Omega_S) \\ Y_1^{-1}(\Omega_1) & \dots & Y_1^{-1}(\Omega_S) \\ \vdots & \ddots & \vdots \\ Y_N^N(\Omega_1) & \dots & Y_N^N(\Omega_S) \end{bmatrix}. \tag{6}$$

All signal values are combined in the signal vector $|x(kT)\rangle$, which considers the time dependencies of each individual source signal $x_s(kT)$, but sampled with a common sample rate of $$\frac{1}{T}:$$

$$|x(kT)\rangle = \begin{bmatrix} x_1(kT) \\ x_2(kT) \\ \vdots \\ x_S(kT) \end{bmatrix}. \tag{7}$$

In the following, for simplicity, in time-variant signals like $|x(kT)\rangle$ the sample number k is no longer described, i.e. it will be neglected. Then $|x\rangle$ is multiplied with the mode matrix $\Xi$ as shown in equation (8). This ensures that all signal components are linearly combined with the corresponding column of the same direction $\Omega_s$, leading to a ket vector $|a_s\rangle$ with O Ambisonics mode components or coefficients according to equation (5):

$$|a_s\rangle = \Xi|x\rangle. \tag{8}$$

The decoder has the task to reproduce the sound field $|a_l\rangle$ represented by a dedicated number of l loudspeaker signals $|y\rangle$. Accordingly, the loudspeaker mode matrix $\Psi$ consists of L separated columns of spherical harmonics based unit vectors $|Y_n^m(\Omega_l)\rangle$ (similar to equation (6)), i.e. one ket for each loudspeaker direction $\Omega_l$:

$$|a_l\rangle = \Psi|y\rangle. \tag{9}$$

For quadratic matrices, where the number of modes is equal to the number of loudspeakers, $|y\rangle$ can be determined by the inverted mode matrix $\Psi$. In the general case of an arbitrary matrix, where the number of rows and columns can be different, the loudspeaker signals $|y\rangle$ can be determined by a pseudo inverse, cf. M. A. Poletti, "A Spherical Harmonic Approach to 3D Surround Sound Systems", Forum Acusticum, Budapest, 2005. Then, with the pseudo inverse $\Psi^+$ of $\Psi$:

$$|y\rangle = \Psi^+|a_l\rangle. \tag{10}$$

It is assumed that sound fields described at encoder and at decoder side are nearly the same, i.e. $|a_s\rangle \approx |a_l\rangle$. However, the loudspeaker positions can be different from the source positions, i.e. for a finite Ambisonics order the real-valued source signals described by $|x\rangle$ and the loudspeaker signals, described by $|y\rangle$ are different. Therefore a panning matrix G can be used which maps $|x\rangle$ on $|y\rangle$. Then, from equations (8) and (10), the chain operation of encoder and decoder is:

$$|y\rangle = G\Psi^+\Xi x\rangle. \tag{11}$$

Linear Functional

In order to keep the following equations simpler, the panning matrix will be neglected until section "Summary of invention". If the number of required basis vectors becomes infinite, one can change from a discrete to a continuous basis. Therefore, a function $f$ can be interpreted as a vector having an infinite number of mode components. This is called a 'functional' in a mathematical sense, because it performs a mapping from ket vectors onto specific output ket vectors in a deterministic way. It can be described by an inner product between the function $f$ and the ket $|x\rangle$, which results in a complex number c in general:

$$\langle f|(|x\rangle) = \sum_{i=1}^{N} f_i \cdot x_i = c. \tag{12}$$

If the functional preserves the linear combination of the ket vectors, $f$ is called 'linear functional'.

As long as there is a restriction to Hermitean operators, the following characteristics should be considered. Hermitean operators always have:

real Eigenvalues.

a complete set of orthogonal Eigen functions for different Eigenvalues.

Therefore, every function can be build up from these Eigen functions, cf. H. Vogel, C. Gerthsen, H. O. Kneser, "Physik", Springer Verlag, 1982. An arbitrary function can be represented as linear combination of spherical harmonics $y_n^m(\Theta, \Phi)$ with complex constants $C_n^m$:

$$f(\theta, \phi) = \sum_{n=0}^{\infty} \sum_{m=-N}^{N} C_n^m \cdot Y_n^m(\theta, \phi) \tag{13}$$

$$\left\langle f(\theta, \phi) \,\middle|\, Y_{n'}^{m'}(\theta, \phi) \right\rangle = \int_0^{2\pi} \int_0^{\pi} f(\theta, \phi) * Y_{n'}^{m'}(\theta, \phi) \sin\theta d\theta d\phi. \tag{14}$$

The indices n, m are used in a deterministic way. They are substituted by a one-dimensional index j, and indices n', m' are substituted by an index i of the same size. Due to the fact that each subspace is orthogonal to a subspace with different i, j, they can be described as linearly independent, orthonormal unit vectors in an infinite-dimensional space:

$$\langle f(\theta, \phi) \mid Y_i(\theta, \phi)\rangle = \int_0^{2\pi} \int_0^{\pi} \left( \sum_{j=0}^{\infty} C_j Y_j(\theta, \phi) \right) * Y_i(\theta, \phi) \sin\theta d\theta d\phi. \tag{15}$$

The constant values of $C_j$ can be set in front of the integral:

$$\langle f(\theta, \phi) \mid Y_i(\theta, \phi)\rangle = \sum_{j=0}^{\infty} C_j^* \int_0^{2\pi} \int_0^{\pi} Y_j^*(\theta, \phi) Y_i(\theta, \phi) \sin\theta d\theta d\phi. \tag{16}$$

A mapping from one subspace (index j) into another subspace (index i) requires just an integration of the harmonics for the same indices i=j as long as the Eigenfunctions $Y_j$ and $Y_i$ are mutually orthogonal:

$$\langle f(\theta, \phi) \mid Y_i(\theta, \phi)\rangle = \sum_{j=0}^{\infty} C_j^* \langle Y_j(\theta, \phi) \mid Y_i(\theta, \phi)\rangle. \tag{17}$$

An essential aspect is that if there is a change from a continuous description to a bra/ket notation, the integral solution can be substituted by the sum of inner products between bra and ket descriptions of the spherical harmonics. In general, the inner product with a continuous basis can be used to map a discrete representation of a ket based wave description $|x\rangle$ into a continuous representation. For example, x(ra) is the ket representation in the position basis (i.e. the radius)

$$ra:\ x(ra)=\langle ra|x\rangle. \tag{18}$$

Looking onto the different kinds of mode matrices Ψ and Ξ, the Singular Value Decomposition is used to handle arbitrary kind of matrices.

Singular Value Decomposition

A singular value decomposition (SVD, cf. G. H. Golub, Ch. F. van Loan, "Matrix Computations", The Johns Hopkins University Press, 3rd edition, 11. October 1996) enables the decomposition of an arbitrary matrix A with m rows and n columns into three matrices U, Σ, and $V^\dagger$, see equation (19). In the original form, the matrices U and $V^\dagger$ are unitary matrices of the dimension m×m and n×n, respectively. Such matrices are orthonormal and are build up from orthogonal columns representing complex unit vectors $|u_i\rangle$ and $|v_i\rangle^\dagger=\langle v_i|$, respectively. Unitary matrices from the complex space are equivalent with orthogonal matrices in real space, i.e. their columns present an orthonormal vector basis:

$$A=U\Sigma V^\dagger. \tag{19}$$

The matrices U and V contain orthonormal bases for all four subspaces.

first r columns of U: column space of A.
last m-r columns of U: nullspace of $A^\dagger$
first r columns of V: row space of A
last n-r columns of V: nullspace of A The matrix Σ contains all singular values which can be used to characterize the behaviour of A. In general, Σ is a by n rectangular diagonal matrix, with up to r diagonal elements $\sigma_i$, where the rank r gives the number of linear independent columns and rows of A(r≤min(m,n)). It contains the singular values in descent order, i.e. in equations (20) and (21) $\sigma_1$ has the highest and $\sigma_r$ the lowest value.

In a compact form only r singular values, i.e., r columns of U and r rows of $V^\dagger$, are required for reconstructing the matrix A. The dimensions of the matrices U, Σ, and $V^\dagger$ differ from the original form. However, the Σ matrices get always a quadratic form. Then, for m>n==r $$\begin{bmatrix} ** \\ * \\ * \\ A \\ * \\ * \\ * \end{bmatrix}_{mxn} = \begin{bmatrix} ** \\ * \\ * \\ U \\ * \\ * \\ * \end{bmatrix}_{mxn} \cdot \begin{bmatrix} \sigma_1 & 0 & \cdot & \cdot \\ 0 & \sigma_2 & 0 & \cdot \\ 0 & 0 & \cdot & 0 \\ \cdot & \cdot & 0 & \sigma_r \end{bmatrix}_{nxn} \begin{bmatrix} ** \\ * \\ V^\dagger \\ *** \end{bmatrix}_{nxn}, \tag{20}$$

and for n>m=r $$\begin{bmatrix} ***** \\ ** \\ A \\ ** \end{bmatrix}_{mxn} = \begin{bmatrix}  \\ * \\ U \\ * \end{bmatrix}_{mxm} \cdot \begin{bmatrix} \sigma_1 & 0 & \cdot & \cdot \\ 0 & \sigma_2 & 0 & \cdot \\ 0 & 0 & \cdot & 0 \\ \cdot & \cdot & 0 & \sigma_r \end{bmatrix}_{mxm} \begin{bmatrix} *** \\ ** \\ V^\dagger \\ **** \end{bmatrix}_{mxn}. \tag{21}$$

Thus the SVD can be implemented very efficiently by a low-rank approximation, see the above-mentioned Golub/van Loan textbook. This approximation describes exactly the original matrix but contains up to r rank-1 matrices. With the Dirac notation the matrix A can be represented by r rank-1 outer products:

$$A=\Sigma_{i=1}^{r}\sigma_i|u_i\rangle\langle v_i|. \tag{22}$$

When looking at the encoder decoder chain in equation (11), there are not only mode matrices for the encoder like matrix but also inverses of mode matrices like matrix Ψ or another sophisticated decoder matrix are to be considered. For a general matrix A, the pseudo inverse $A^+$ of A can be directly examined from the SVD by performing the inversion of the square matrix Σ and the conjugate complex transpose of V and $V^\dagger$, which results to:

$$A^+=V\Sigma^{-1}U^\dagger. \tag{23}$$

For the vector based description of equation (22), the pseudo inverse $A^+$ is got by performing the conjugate transpose of $|u_i\rangle$ and $\langle v_i|$ whereas the singular values $\sigma_i$ have to be inverted. The resulting pseudo inverse looks as follows:

$$A^+ = \sum_{i=1}^{r}\left(\frac{1}{\sigma_i}\right)|v_i\rangle\langle u_i|. \tag{24}$$

If the SVD based decomposition of the different matrices is combined with a vector based description (cf. equations (8) and (10)) one gets for the encoding process:

$$|a_s\rangle = \sum_{s_i=1}^{r_s}\sigma_{s_i}|u_{s_i}\rangle\langle v_{s_i}|\cdot|x\rangle = \sum_{s_i=1}^{r_s}\sigma_{s_i}|u_{s_i}\rangle\langle v_{s_i}|x\rangle, \tag{25}$$

and for the decoder when considering the pseudo inverse matrix $\Psi^+$ (equation (24)):

$$|y\rangle = \left(\sum_{l_i=1}^{r_l}\left(\frac{1}{\sigma_{l_i}}\right)|v_{l_i}\rangle\langle u_{l_i}|\right)|a_l\rangle. \tag{26}$$

If it is assumed that the Ambisonics sound field description $|a_s\rangle$ from the encoder is nearly the same as $|a_l\rangle$ for the decoder, and the dimensions $r_s=r_l=r$, than with respect to the input signal $|x\rangle$ and the output signal $|y\rangle$ a combined equation looks as follows:

$$|y\rangle = \left(\sum_{l_i=1}^{r}\left(\frac{1}{\sigma_{l_i}}\right)|v_{l_i}\rangle\langle u_{l_i}|\right)\sum_{s_i=1}^{r}\sigma_{s_i}|u_{s_i}\rangle\langle v_{s_i}|x\rangle. \tag{27}$$

SUMMARY OF INVENTION

However, this combined description of the encoder decoder chain has some specific problems which are described in the following.

Influence on Ambisonics Matrices

Higher Order Ambisonics (HOA) mode matrices Ξ and Ψ are directly influenced by the position of the sound sources or the loudspeakers (see equation (6)) and their Ambisonics order. If the geometry is regular, i.e. the mutually angular distances between source or loudspeaker positions are nearly equal, equation (27) can be solved.

But in real applications this is often not true. Thus it makes sense to perform an SVD of $\Xi$ and $\Psi$, and to investigate their singular values in the corresponding matrix $\Sigma$ because it reflects the numerical behaviour of $\Xi$ and $\Psi$. $\Sigma$ is a positive definite matrix with real singular values. But nevertheless, even if there are up to r singular values, the numerical relationship between these values is very important for the reproduction of sound fields, because one has to build the inverse or pseudo inverse of matrices at decoder side. A suitable quantity for measuring this behaviour is the condition number of A. The condition number $\kappa(A)$ is defined as ratio of the smallest and the largest singular value:

$$\kappa(A) = \frac{\sigma_r}{\sigma_1}.$$

Inverse Problems

Ill-conditioned matrices are problematic because they have a large $\kappa(A)$. In case of an inversion or pseudo inversion, an ill-conditioned matrix leads to the problem that small singular values $\sigma_i$ become very dominant. In P. Ch. Hansen, "Rank-Deficient and Discrete Ill-Posed Problems: Numerical Aspects of Linear Inversion", Society for Industrial and Applied Mathematics (SIAM), 1998, two fundamental types of problems are distinguished (chapter 1.1, pages 2-3) by describing how singular values are decaying:

- Rank-deficient problems, where the matrices have a gap between a cluster of large and small singular values (nongradually decay);
- Discrete ill-posed problems, where in average all singular values of the matrices decay gradually to zero, i.e. without a gap in the singular values spectrum.

Concerning the geometry of microphones at encoder side as well as for the loudspeaker geometry at decoder side, mainly the first rank-deficient problem will occur. However, it is easier to modify the positions of some microphones during the recording than to control all possible loudspeaker positions at customer side. Especially at decoder side an inversion or pseudo inversion of the mode matrix is to be performed, which leads to numerical problems and over-emphasised values for the higher mode components (see the above-mentioned Hansen book).

Signal Related Dependency

Reducing that inversion problem can be achieved for example by reducing the rank of the mode matrix, i.e. by avoiding the smallest singular values. But then a threshold is to be used for the smallest possible value $\sigma_r$ (cf. equations (20) and (21)). An optimal value for such lowest singular value is described in the above-mentioned Hansen book. Hansen proposes $$\sigma_{opt} = \frac{1}{\sqrt{SNR}},$$

which depends on the characteristic of the input signal (here described by $|x\rangle$. From equation (27) it can be see, that this signal has an influence on the reproduction, but the signal dependency cannot be controlled in the decoder.

Problems with Non-Orthonormal Basis

The state vector $|a_s\rangle$, transmitted between the HOA encoder and the HOA decoder, is described in each system in a different basis according to equations (25) and (26). However, the state does not change if an orthonormal basis is used. Then the mode components can be projected from one to another basis. So, in principle, each loudspeaker setup or sound description should build on an orthonormal basis system because this allows the change of vector representations between these bases, e.g. in Ambisonics a projection from 3D space into the 2D subspace.

However, there are often setups with ill-conditioned matrices where the basis vectors are nearly linear dependent. So, in principle, a non-orthonormal basis is to be dealt with. This complicates the change from one subspace to another subspace, which is necessary if the HOA sound field description shall be adopted onto different loudspeaker setups, or if it is desired to handle different HOA orders and dimensions at encoder or decoder sides.

A typical problem for the projection onto a sparse loudspeaker set is that the sound energy is high in the vicinity of a loudspeaker and is low if the distance between these loudspeakers is large. So the location between different loudspeakers requires a panning function that balances the energy accordingly.

The problems described above can be circumvented by the inventive processing, and are solved by the method disclosed in claim 1. An apparatus that utilises this method is disclosed in claim 2.

According to the invention, a reciprocal basis for the encoding process in combination with an original basis for the decoding process are used with consideration of the lowest mode matrix rank, as well as truncated singular value decomposition. Because a bi-orthonormal system is represented, it is ensured that the product of encoder and decoder matrices preserves an identity matrix at least for the lowest mode matrix rank.

This is achieved by changing the ket based description to a representation based in the dual space, the bra space with reciprocal basis vectors, where every vector is the adjoint of a ket. It is realised by using the adjoint of the pseudo inverse of the mode matrices. 'Adjoint' means complex conjugate transpose.

Thus, the adjoint of the pseudo inversion is used already at encoder side as well as the adjoint decoder matrix. For the processing orthonormal reciprocal basis vectors are used in order to be invariant for basis changes. Furthermore, this kind of processing allows to consider input signal dependent influences, leading to noise reduction optimal thresholds for the $\sigma_i$ in the regularisation process.

In principle, the inventive method is suited for Higher Order Ambisonics encoding and decoding using Singular Value Decomposition, said method including the steps:

- receiving an audio input signal;
- based on direction values of sound sources and the Ambisonics order of said audio input signal, forming corresponding ket vectors of spherical harmonics and a corresponding encoder mode matrix;
- carrying out on said encoder mode matrix a Singular Value Decomposition, wherein two corresponding encoder unitary matrices and a corresponding encoder diagonal matrix containing singular values and a related encoder mode matrix rank are output;
- determining from said audio input signal, said singular values and said encoder mode matrix rank a threshold value;

comparing at least one of said singular values with said threshold value and determining a corresponding final encoder mode matrix rank;

based on direction values of loudspeakers and a decoder Ambisonics order, forming corresponding ket vectors of spherical harmonics for specific loudspeakers located at directions corresponding to said direction values and a corresponding decoder mode matrix;

carrying out on said decoder mode matrix a Singular Value Decomposition, wherein two corresponding decoder unitary matrices and a corresponding decoder diagonal matrix containing singular values are output and a corresponding final rank of said decoder mode matrix is determined;

determining from said final encoder mode matrix rank and said final decoder mode matrix rank a final mode matrix rank;

calculating from said encoder unitary matrices, said encoder diagonal matrix and said final mode matrix rank an adjoint pseudo inverse of said encoder mode matrix, resulting in an Ambisonics ket vector, and reducing the number of components of said Ambisonics ket vector according to said final mode matrix rank, so as to provide an adapted Ambisonics ket vector;

calculating from said adapted Ambisonics ket vector, said decoder unitary matrices, said decoder diagonal matrix and said final mode matrix rank an adjoint decoder mode matrix resulting in a ket vector of output signals for all loudspeakers.

In principle the inventive apparatus is suited for Higher Order Ambisonics encoding and decoding using Singular Value Decomposition, said apparatus including means being adapted for:

receiving an audio input signal;

based on direction values of sound sources and the Ambisonics order of said audio input signal, forming corresponding ket vectors of spherical harmonics and a corresponding encoder mode matrix;

carrying out on said encoder mode matrix a Singular Value Decomposition, wherein two corresponding encoder unitary matrices and a corresponding encoder diagonal matrix containing singular values and a related encoder mode matrix rank are output;

determining from said audio input signal, said singular values and said encoder mode matrix rank a threshold value;

comparing at least one of said singular values with said threshold value and determining a corresponding final encoder mode matrix rank;

based on direction values of loudspeakers and a decoder Ambisonics order, forming corresponding ket vectors of spherical harmonics for specific loudspeakers located at directions corresponding to said direction values and a corresponding decoder mode matrix;

carrying out on said decoder mode matrix a Singular Value Decomposition, wherein two corresponding decoder unitary matrices and a corresponding decoder diagonal matrix containing singular values are output and a corresponding final rank of said decoder mode matrix is determined;

determining from said final encoder mode matrix rank and said final decoder mode matrix rank a final mode matrix rank;

calculating from said encoder unitary matrices, said encoder diagonal matrix and said final mode matrix rank an adjoint pseudo inverse of said encoder mode matrix, resulting in an Ambisonics ket vector, and reducing the number of components of said Ambisonics ket vector according to said final mode matrix rank, so as to provide an adapted Ambisonics ket vector;

calculating from said adapted Ambisonics ket vector, said decoder unitary matrices, said decoder diagonal matrix and said final mode matrix rank an adjoint decoder mode matrix resulting in a ket vector of output signals for all loudspeakers.

Advantageous additional embodiments of the invention are disclosed in the respective dependent claims.

An aspect of the invention relates to methods, apparatus and systems for Higher Order Ambisonics (HOA) decoding. Information regarding vectors describing a state of spherical harmonics for loudspeakers may be the received. Vectors describing the state of spherical harmonics may be determined, wherein the vectors were determined based on a Singular Value Decomposition, and wherein the vectors are based on a matrix of information related to the vectors. A resulting HOA representation of vector-based signals based on the vectors describing the state of the spherical harmonics may be determined. The matrix of the information related to the vectors was adapted based on direction of sound sources and wherein the matrix is based on a rank that provides a number of linear independent columns and rows related to the vectors. There may be further received information regarding direction values ($\Omega_l$) of loudspeakers and a decoder Ambisonics order ($N_l$). Vectors for loudspeakers located at directions corresponding to the direction values ($\Omega_l$) and a decoder mode matrix ($\Psi_{O\times L}$) based on the direction values ($\Omega_l$) of loudspeakers and the decoder Ambisonics order ($N_l$) may be determined. Two corresponding decoder unitary matrices ($U_l^{\dagger}$, $V_l$) and a decoder diagonal matrix ($\Sigma_l$) containing singular values and a final rank ($r_{fin_d}$) of the decoder mode matrix ($\Psi_{O\times L}$) may be determined based on a Singular Value Decomposition of the decoder mode matrix ($\Psi_{O\times L}$). Vectors ($|Y(\Omega_l)\rangle$) of the spherical harmonics for the loudspeakers and the decoder mode matrix ($\Psi_{O\times L}$) may be based on a corresponding panning function ($f_l$) that includes a linear operation and a mapping of the source positions in the audio input signal ($|x(\Omega_z)\rangle$) to positions of the loudspeakers in the vector ($|y(\Omega_l)\rangle$) of loudspeaker output signals.

BRIEF DESCRIPTION OF DRAWINGS

Exemplary embodiments of the invention are described with reference to the accompanying drawings, which show in.

DESCRIPTION OF EMBODIMENTS

Figure 1:
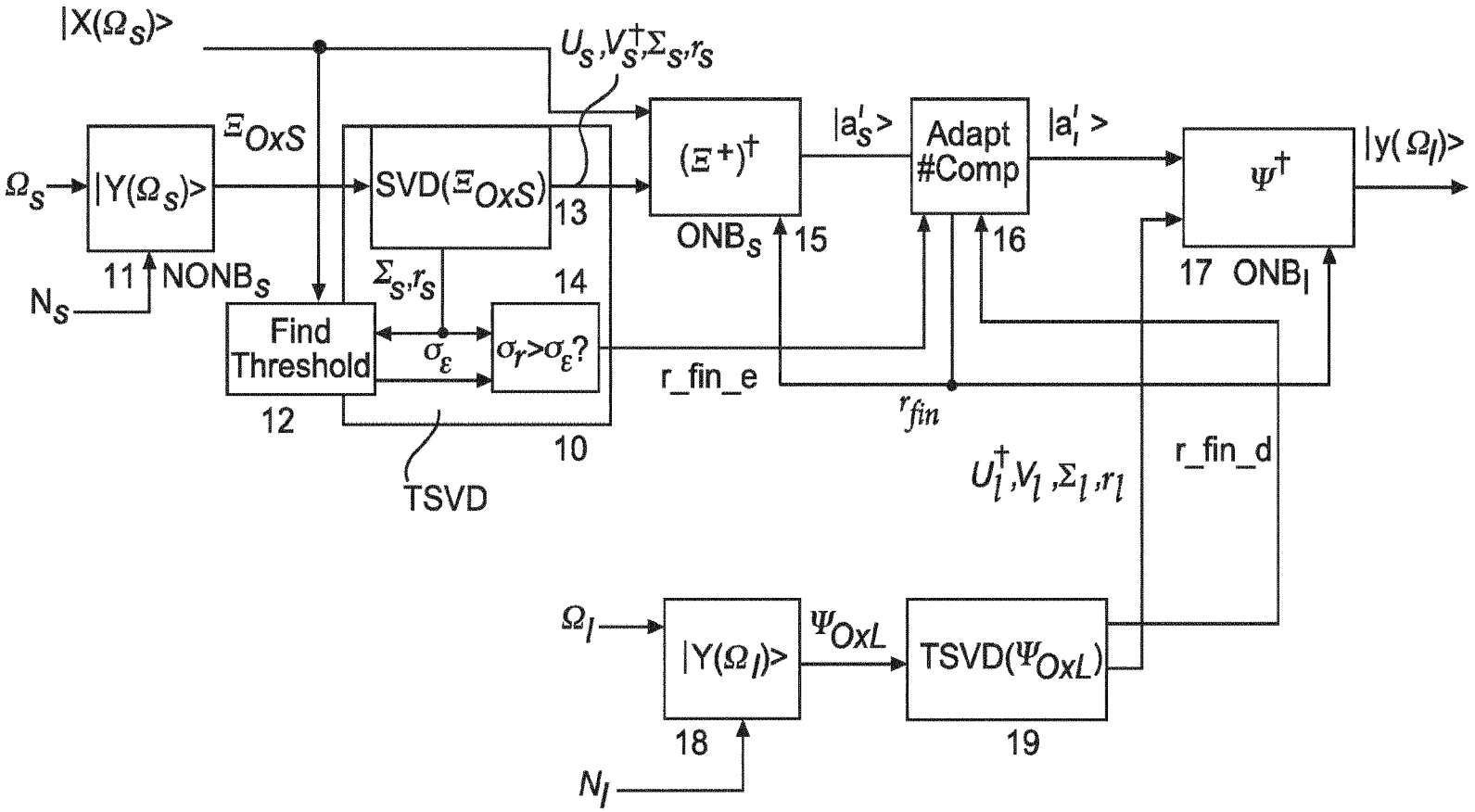
FIG. 1 illustrates a block diagram of HOA encoder and decoder based on SVD.

A block diagram for the inventive HOA processing based on SVD is depicted in FIG. 1 with the encoder part and the decoder part. Both parts are using the SVD in order to generate the reciprocal basis vectors. There are changes with respect to known mode matching solutions, e.g. the change related to equation (27).

HOA Encoder

To work with reciprocal basis vectors, the ket based description is changed to the bra space, where every vector is the Hermitean conjugate or adjoint of a ket. It is realised by using the pseudo inversion of the mode matrices.

Then, according to equation (8), the (dual) bra based Ambisonics vector can also be reformulated with the (dual) mode matrix $\Xi_d$:

$$\langle a_s| = \langle x|\Xi_d = \langle x|\Xi^+. \tag{29}$$

The resulting Ambisonics vector at encoder side $\langle a_s|$ is now in the bra semantic. However, a unified description is desired, i.e. return to the ket semantic. Instead of the pseudo inverse of $\Xi$, the Hermitean conjugate of $\Xi_d^\dagger$ or $\Xi^\dagger$ is used:

$$|a_s\rangle = \Xi_d^\dagger|x\rangle = \Xi^{+\dagger}|x\rangle. \tag{30}$$

According to equation (24)

$$\Xi^{+\dagger} = \left(\sum_{i=1}^{r_s}\left(\frac{1}{\sigma_{s_i}}\right)|v_{s_i}\rangle\langle u_{s_i}|\right)^\dagger = \sum_{i=1}^{r_s}\left(\frac{1}{\sigma_{s_i}}\right)|u_{s_i}\rangle\langle v_{s_i}|, \tag{31}$$

where all singular values are real and the complex conjugation of $\sigma_{s_i}$ can be neglected.

This leads to the following description of the Ambisonics components:

$$|a_s\rangle = \sum_{i=1}^{r_s}\left(\frac{1}{\sigma_{s_i}}\right)|u_{s_i}\rangle\langle v_{s_i}|x\rangle. \tag{32}$$

The vector based description for the source side reveals that $|a_s\rangle$ depends on the inverse $\sigma_{s_i}$. If this is done for the encoder side, it is to be changed to corresponding dual basis vectors at decoder side.

HOA Decoder

In case the decoder is originally based on the pseudo inverse, one gets for deriving the loudspeaker signals $|y\rangle$:

$$|a_l\rangle = \Psi^{+\dagger}|y\rangle, \tag{33}$$

i.e. the loudspeaker signals are:

$$|y\rangle = (\Psi^{+\dagger})^+\cdot|a_l\rangle = \Psi^\dagger\cdot|a_l\rangle. \tag{34}$$

Considering equation (22), the decoder equation results in:

$$|y\rangle = (\Sigma_{i=1}^r\sigma_{l_i}|u_{l_i}\rangle(v_{l_i}|)^\dagger|a_l\rangle. \tag{35}$$

Therefore, instead of building a pseudo inverse, only an adjoint operation (denoted by '†') is remaining in equation (35). This means that less arithmetical operations are required in the decoder, because one only has to switch the sign of the imaginary parts and the transposition is only a matter of modified memory access:

$$|y\rangle = \left(\sum_{i=1}^{r}\sigma_{l_i}\cdot|v_{l_i}\rangle\langle u_{l_i}|\right)|a_l\rangle. \tag{36}$$

If it is assumed that the Ambisonics representations of the encoder and the decoder are nearly the same, i.e. $|a_z\rangle = |a_l\rangle$ with equation (32) the complete encoder decoder chain gets the following dependency:

$$|y\rangle = \sum_{i=1}^{r}\left(\frac{\sigma_{l_i}}{\sigma_{s_i}}\right)\cdot|v_{l_i}\rangle\langle u_{l_i}|u_{s_i}\rangle\langle v_{s_i}|x\rangle, \tag{37}$$

$$|y\rangle = \sum_{i=1}^{r}\left(\frac{\sigma_{l_i}}{\sigma_{s_i}}\right)\langle u_{l_i}|u_{s_i}\rangle\cdot|v_{l_i}\rangle\langle v_{s_i}|x\rangle. \tag{38}$$

In a real scenario the panning matrix G from equation (11) and a finite Ambisonics order are to be considered. The latter leads to a limited number of linear combinations of basis vectors which are used for describing the sound field. Furthermore, the linear independence of basis vectors is influenced by additional error sources, like numerical rounding errors or measurement errors. From a practical point of view, this can be circumvented by a numerical rank (see the above-mentioned Hansen book, chapter 3.1), which ensures that all basis vectors are linearly independent within certain tolerances.

To be more robust against noise, the SNR of input signals is considered, which affects the encoder ket and the calculated Ambisonics representation of the input. So, if necessary, i.e. for ill-conditioned mode matrices that are to be inverted, the $\sigma_i$ value is regularised according to the SNR of the input signal in the encoder.

Regularisation in the Encoder

Regularisation can be performed by different ways, e.g. by using a threshold via the truncated SVD. The SVD provides the $\sigma_i$ in a descending order, where the $\sigma_i$ with lowest level or highest index (denoted $\sigma_r$) contains the components that switch very frequently and lead to noise effects and SNR (cf. equations (20) and (21) and the above-mentioned Hansen textbook). Thus a truncation SVD (TSVD) compares all $\sigma_i$ values with a threshold value and neglects the noisy components which are beyond that threshold value $\sigma_s$. The threshold value $\sigma_s$ can be fixed or can be optimally modified according to the SNR of the input signals.

The trace of a matrix means the sum of all diagonal matrix elements.

The TSVD block (10, 20, 30 in FIGS. 1 to 3) has the following tasks:

computing the mode matrix rank r;

removing the noisy components below the threshold value and setting the final mode matrix rank $r_{fin}$.

The processing deals with complex matrices $\Xi$ and $\Psi$. However, for regularising the real valued $\sigma_i$, these matrices cannot be used directly. A proper value comes from the product between $\Xi$ with its adjoint $\Xi^\dagger$. The resulting matrix is quadratic with real diagonal eigenvalues which are equivalent with the quadratic values of the appropriate singular values. If the sum of all eigenvalues, which can be described by the trace of matrix $$\Sigma^2\text{trace}(\Sigma^2) = \Sigma_{i=1}^r\sigma_i^2, \tag{39}$$

stays fixed, the physical properties of the system are conserved. This also applies for matrix $\Psi$.

Thus block $ONB_S$ at the encoder side (15,25,35 in FIG. 1-3) or block $ONB_l$ at the decoder side (19,29,39 in FIG. 1-3) modify the singular values so that trace($\Sigma^2$) before and after regularisation is conserved (cf. FIG. 5 and FIG. 6):

Modify the rest of $\sigma_i$ (for i=1 . . . $r_{fin}$) such that the trace of the original and the aimed truncated matrix $\Sigma_t$ stays fixed trace($\Sigma^2$)=trace($\Sigma_t^2$)).

Calculate a constant value $\Delta\sigma$ that fulfils $$\Sigma_{i=1}^{r}\sigma_i^2=\Sigma_{i=1}^{rfin}(\sigma_i+\Delta\sigma)^2. \tag{40}$$

If the difference between normal and reduced number of singular values is called ($\Delta E$=trace($\Sigma$)=trace($\Sigma$)$_{r_{fin}}$), the resulting value is as follows:

$$\Delta\sigma = \frac{1}{r_{fin}}\left(-\sum_{i=1}^{rfin}\sigma_i + \sqrt{\left[\sum_{i=1}^{rfin}\sigma_i\right]^2 + r_{fin}\Delta E}\right) = \frac{1}{r_{fin_d}}\left(-\mathrm{trace}(\Sigma)_{rfin} + \sqrt{\mathrm{trace}(\Sigma)_{rfin}^2 + r_{fin_d}\Delta E}\right) \tag{41}$$

Re-calculate all new singular values $\sigma_{i,t}$ for the truncated matrix $\Sigma_t$:

$$\sigma_{i,t}=\sigma_i+\Delta\sigma. \tag{42}$$

Additionally, a simplification can be achieved for the encoder and the decoder if the basis for the appropriate $|a\rangle$ (see equations (30) or (33)) is changed into the corresponding SVD-related $\{U^\dagger\}$ basis, leading to:

$$|a'\rangle = \sum_{i=1}^{rfin}\langle u_i|\left[\sum_{i=1}^{rfin}\sigma_{i,t}|u_i\rangle\langle v_i|\right]|a\rangle = \sum_{i=1}^{rfin}\sigma_{i,t}\langle v_i|a\rangle \tag{43}$$

(remark: if $\sigma_i$ and $|a\rangle$ are used without additional encoder or decoder index, they refer to encoder side or/and to decoder side). This basis is orthonormal so that it preserves the norm of $|a\rangle$. I.e., instead of $|a\rangle$ the regularisation can use $|a'\rangle$ which requires matrices $\Sigma$ and V but no longer matrix U.

Use of the reduced ket in the $|a'\rangle$ in the $\{U^\dagger\}$ basis, which has the advantage that the rank is reduced in deed.

Therefore in the invention the SVD is used on both sides, not only for performing the orthonormal basis and the singular values of the individual matrices $\Xi$ and $\Psi$, but also for getting their ranks $r_{fin}$.

Component Adaption

By considering the source rank of $\Xi$ or by neglecting some of the corresponding $\sigma_s$ with respect to the threshold or the final source rank, the number of components can be reduced and a more robust encoding matrix can be provided. Therefore, an adaption of the number of transmitted Ambisonics components according to the corresponding number of components at decoder side is performed. Normally, it depends on Ambisonics order O. Here, the final mode matrix rank $$r_{fin_e}$$

got from the SVD block for the encoder matrix $\Xi$ and the final mode matrix rank $r_{fin_d}$ got from the SVD block for the decoder matrix $\Psi$ are to be considered. In Adapt#Comp step/stage 16 the number of components is adapted as follows:

$$r_{fin_e} = r_{fin_d}:$$

changed—no compression;

$$r_{fin_e} < r_{fin_d}:$$

compression, neglect $$r_{fin_e} - r_{fin_d}$$

columns in the decoder matrix $\Psi^\dagger$=>encoder and decoder operations reduced;

$$r_{fin_e} > r_{fin_d}:$$

cancel $$r_{fin_e} > r_{fin_d}$$

components of the Ambisonics state vector before transmission, i.e. compression. Neglect $$r_{fin_e} - r_{fin_d}$$

rows in the encoder matrix $\Xi$=>encoder and decoder operations reduced.

The result is that the final mode matrix rank $r_{fin}$ to be used at encoder side and at decoder side is the smaller one of $$r_{fin_d}$$

and $$r_{fin_e}.$$

Thus, if a bidirectional signal between encoder and decoder exists for interchanging the rank of the other side, one can use the rank differences to improve a possible compression and to reduce the number of operations in the encoder and in the decoder.

Consider Panning Functions

The use of panning functions $f_s$, $f_l$ or of the panning matrix G was mentioned earlier, see equation (11), due to the problems concerning the energy distribution which are got for sparse and irregular-loudspeaker setups. These problems have to deal with the limited order that can normally be used in Ambisonics (see sections Influence on Ambisonics matrices to Problems with non-orthonormal basis).

Regarding the requirements for panning matrix G, following encoding it is assumed that the sound field of some acoustic sources is in a good state represented by the Ambisonics state vector $|a_s\rangle$. However, at decoder side it is not known exactly how the state has been prepared. I.e., there is no complete knowledge about the present state of the system. Therefore the reciprocal basis is taken for preserving the inner product between equations (9) and (8).

Using the pseudo inverse already at encoder side provides the following advantages:

- use of reciprocal basis satisfies bi-orthogonality between encoder and decoder basis ($\langle x^i | x_j \rangle = \delta_j^i$);
- smaller number of operations in the encoding/decoding chain;
- improved numerical aspects concerning SNR behaviour;
- orthonormal columns in the modified mode matrices instead of only linearly independent ones;
- it simplifies the change of the basis;
- use rank-1 approximation leads to less memory effort and a reduced number of operations, especially if the final rank is low. In general, for a M×N matrix, instead of M*N only M+N operations are required;
- it simplifies the adaptation at decoder side because the pseudo inverse in the decoder can be avoided;
- the inverse problems with numerical unstable σ can be circumvented.

In FIG. 1, at encoder or sender side, s=1, . . . , S different direction values $\Omega_s$ of sound sources and the Ambisonics order $N_s$ are input to a step or stage 11 which forms therefrom corresponding ket vectors $|Y(\Omega_s)\rangle$ of spherical harmonics and an encoder mode matrix $\Xi_{O\times S}$ having the dimension O×S. Matrix $\Xi_{O\times S}$ is generated in correspondence to the input signal vector $|x(\Omega_s)\rangle$, which comprises S source signals for different directions $\Omega_s$. Therefore matrix $\Xi_{O\times S}$ is a collection of spherical harmonic ket vectors $|Y(\Omega_s)\rangle$. Because not only the signal $x(\Omega_s)$, but also the position varies with time, the calculation matrix $\Xi_{O\times S}$ can be performed dynamically. This matrix has a non-orthonormal basis $NONB_s$ for sources. From the input signal $|x(\Omega_s)\rangle$ and a rank value $r_s$ a specific singular threshold value $\sigma_s$ is determined in step or stage 12.

The encoder mode matrix $\Xi_{O\times S}$ and threshold value $\sigma_s$ are fed to a truncation singular value decomposition TSVD processing 10 (cf. above section Singular value decomposition), which performs in step or stage 13 a singular value decomposition for mode matrix $\Xi_{O\times S}$ in order to get its singular values, whereby on one hand the unitary matrices U and $V^\dagger$ and the diagonal matrix Σ containing $r_s$ singular values $\sigma_1 \ldots \sigma_{r_s}$ are output and on the other hand the related encoder mode matrix rank $r_s$ is determined (Remark: $\sigma_i$ is the i-th singular value from matrix Σ of SVD(Ξ)=UΣV$^\dagger$).

In step/stage 12 the threshold value $\sigma_s$ is determined according to section Regularisation in the encoder. Threshold value $\sigma_s$ can limit the number of used $\sigma_{s_i}$ values to the truncated or final encoder mode matrix rank $$r_{fin_s}.$$

Threshold value $\sigma_s$ can be set to a predefined value, or can be adapted to the signal-to-noise ratio SNR of the input signal:

$$\sigma_{s,opt} = \frac{1}{\sqrt{SNR}},$$

whereby the SNR of all S source signals $|x(\Omega_s)\rangle$ is measured over a predefined number of sample values.

In a comparator step or stage 14 the singular value $\sigma_r$ from matrix Σ is compared with the threshold value $\sigma_s$, and from that comparison the truncated or final encoder mode matrix rank $$r_{fin_s}$$

is calculated that modifies the rest of the $\sigma_{s_i}$ values according to section Regularisation in the encoder. The final encoder mode matrix rank $$r_{fin_e}$$

is fed to a step or stage 16.

Regarding the decoder side, from l=1, . . . , L direction values $\Omega_l$ of loudspeakers and from the decoder Ambisonics order $N_l$, corresponding ket vectors $|Y(\Omega_l)\rangle$ of spherical harmonics for specific loudspeakers at directions $\Omega_l$ as well as a corresponding decoder mode matrix $\Psi_{O\times L}$ having the dimension O×L are determined in step or stage 18, in correspondence to the loudspeaker positions of the related signals $|y(\Omega_l)\rangle$ in block 17. Similar to the encoder matrix $\Xi_{O\times S}$, decoder matrix $\Psi_{O\times L}$ is a collection of spherical harmonic ket vectors $|Y(\Omega_l)\rangle$ for all directions $\Omega_l$. The calculation of $\Psi_{O\times L}$ is performed dynamically.

In step or stage 19 a singular value decomposition processing is carried out on decoder mode matrix $\Psi_{O\times L}$ and the resulting unitary matrices U and $V^\dagger$ as well as diagonal matrix Σ are fed to block 17. Furthermore, a final decoder mode matrix rank $$r_{fin_d}$$

is calculated and is fed to step/stage 16.

In step or stage 16 the final mode matrix rank $r_{fin}$ is determined, as described above, from final encoder mode matrix rank $$r_{fin_e}$$

and from final decoder mode matrix rank $$r_{fin_d}.$$

Final mode matrix rank $r_{fin}$ is fed to step/stage 15 and to step/stage 17.

Encoder-side matrices $U_s$, $V_s^\dagger$, $\Sigma_s$, rank value $r_s$, final mode matrix rank value $r_{fin}$ and the time dependent input signal ket vector $|x(\Omega_s)\rangle$ of all source signals are fed to a step or stage 15, which calculates using equation (32) from these $\Xi_{O\times S}$ related input values the adjoint pseudo inverse $(\Xi^+)^\dagger$ of the encoder mode matrix. This matrix has the dimension $$r_{fin_e} x S$$

and an orthonormal basis for sources $ONB_s$. When dealing with complex matrices and their adjoints, the following is considered: $\Sigma_{O\times S}{}^\dagger \Xi_{O\times S} = \mathrm{trace}(\Sigma^2) = \Sigma_{i=1}{}^{r} \sigma_{s_i}{}^2$. Step/stage 15 outputs the corresponding time-dependent Ambisonics ket or state vector $|a'_s\rangle$, cf. above section HOA encoder.

In step or stage 16 the number of components of $|a'_s\rangle$ is reduced using final mode matrix rank $r_{fin}$ as described in above section Component adaption, so as to possibly reduce the amount of transmitted information, resulting in time-dependent Ambisonics ket or state vector $|a'_l\rangle$ after adaption.

From Ambisonics ket or state vector $|a'_l\rangle$ from the decoder-side matrices $U_l^\dagger$, $V_l$, $\Sigma_l$ and the rank value $r_l$ derived from mode matrix $\Psi_{O\times L}$, and from the final mode matrix rank value $r_{fin}$ from step/stage 16 an adjoint decoder mode matrix $(\Psi)^\dagger$ having the dimension $$Lxr_{fin_d}$$

and an orthonormal basis for loudspeakers $ONB_l$ is calculated, resulting in a ket vector $|y(\Omega_l)\rangle$ of time-dependent output signals of all loudspeakers, cf. above section HOA decoder. The decoding is performed with the conjugate transpose of the normal mode matrix, which relies on the specific loudspeaker positions.

For an additional rendering a specific panning matrix should be used.

The decoder is represented by steps/stages 18, 19 and 17. The encoder is represented by the other steps/stages.

Figure 2:
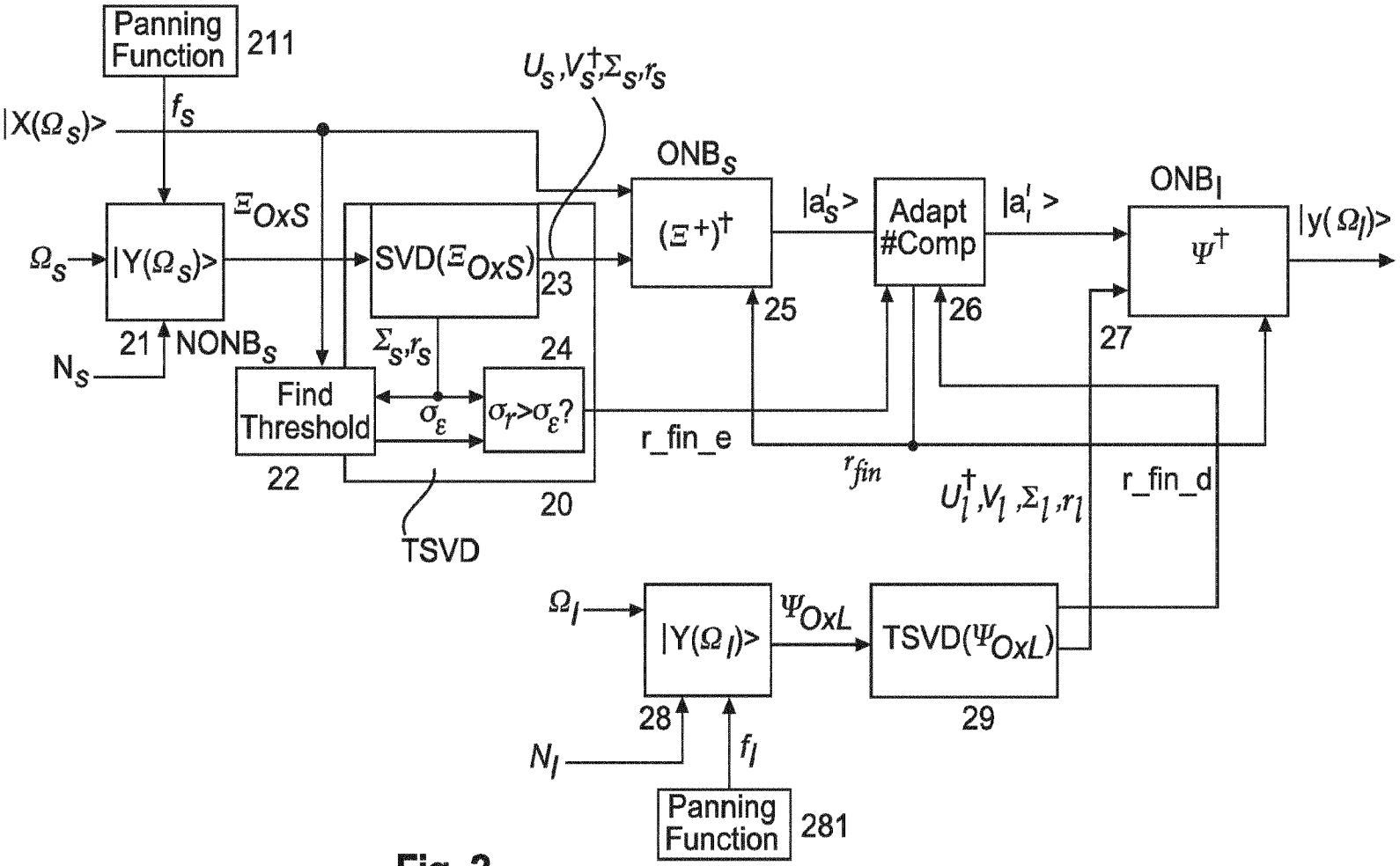
FIG. 2 illustrates a block diagram of HOA encoder and decoder including linear functional panning.
Figure 3:
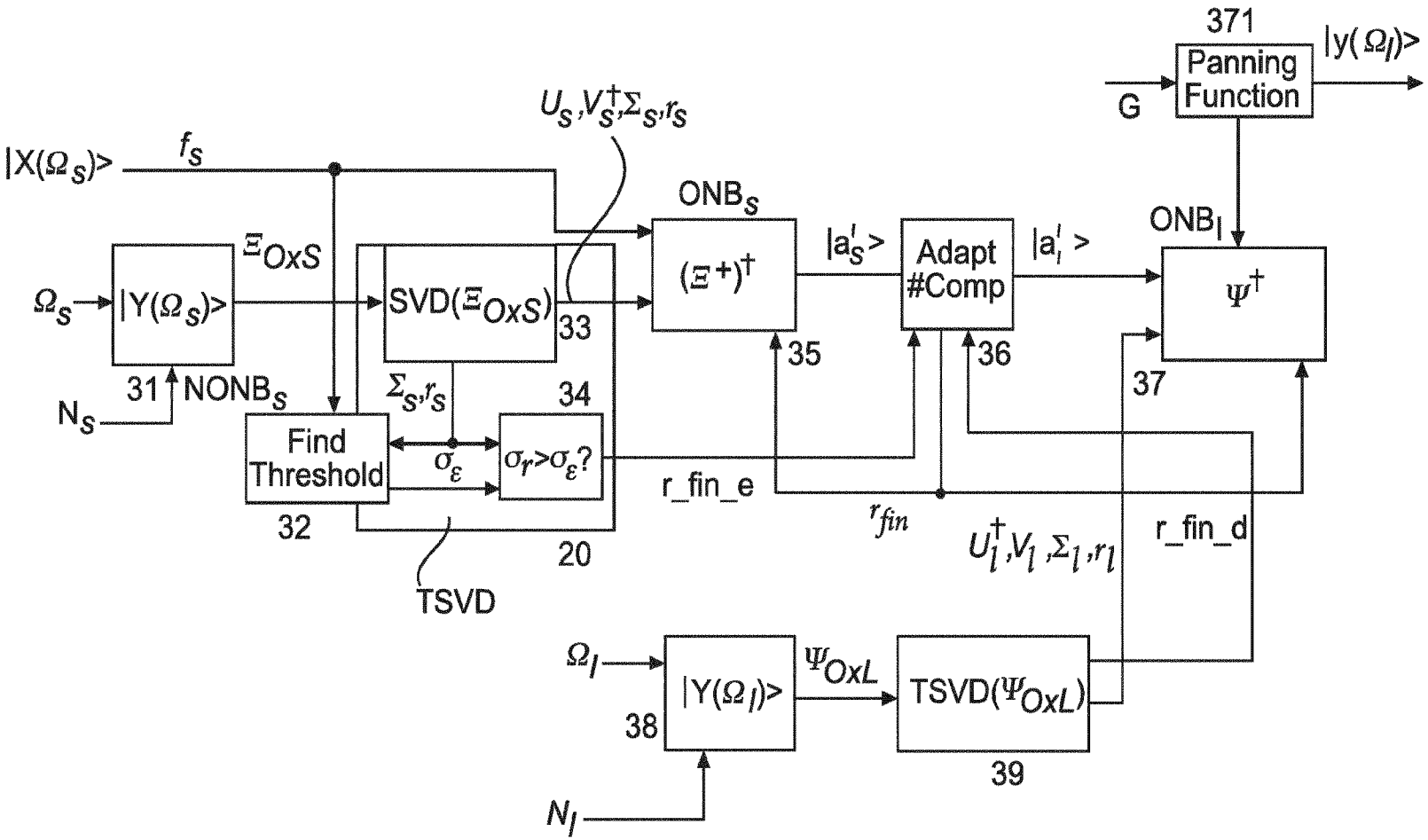
FIG. 3 illustrates a block diagram of HOA encoder and decoder including matrix panning.

Steps/stages 11 to 19 of FIG. 1 correspond in principle to steps/stages 21 to 29 in FIG. 2 and steps/stages 31 to 39 in FIG. 3, respectively.

In FIG. 2 in addition a panning function $f_s$ for the encoder side calculated in step or stage 211 and a panning function $f_l$ 281 for the decoder side calculated in step or stage 281 are used for linear functional panning. Panning function $f_s$ is an additional input signal for step/stage 21, and panning function $f_l$ is an additional input signal for step/stage 28. The reason for using such panning functions is described in above section Consider panning functions.

In comparison to FIG. 1, in FIG. 3 a panning matrix & controls a panning processing 371 on the preliminary ket vector of time-dependent output signals of all loudspeakers at the output of step/stage 37. This results in the adapted ket vector $|y(\Omega_l)\rangle$ of time-dependent output signals of all loudspeakers.

Figure 4:
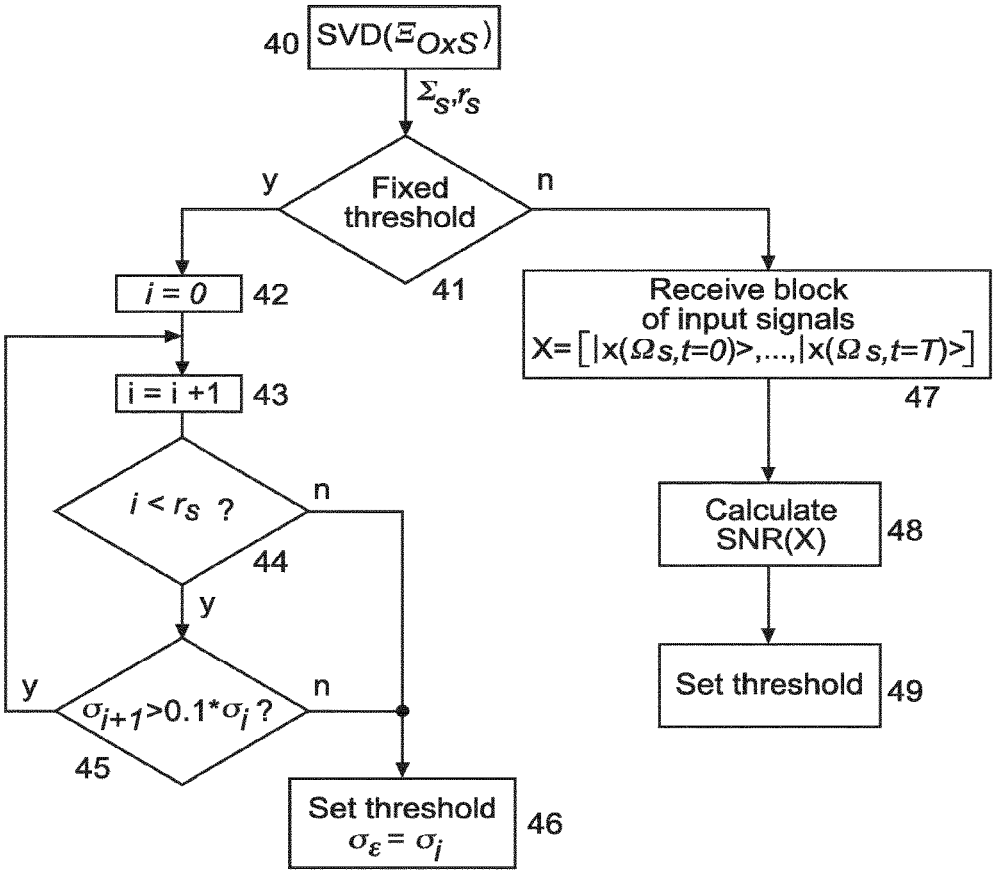
FIG. 4 illustrates a flow diagram for determining threshold value $\sigma_s$.

FIG. 4 shows in more detail the processing for determining threshold value $\sigma_s$ based on the singular value decomposition SVD processing 40 of encoder mode matrix $\Xi_{O\times S}$. That SVD processing delivers matrix $\Sigma$ (containing in its descending diagonal all singular values $\sigma_i$ running from $\sigma_1$ to $\sigma_{r_s}$ see equations (20) and (21)) and the rank $r_s$, of matrix $\Sigma$.

In case a fixed threshold is used (block 41), within a loop controlled by variable (blocks 42 and 43), which loop starts with i=1 and can run up to $i=r_s$, it is checked (block 45) whether there is an amount value gap in between these $\sigma_i$ values. Such gap is assumed to occur if the amount value of a singular value $\sigma_{i+1}$ is significantly smaller, for example smaller than 1/10, than the amount value of its predecessor singular value $\sigma_i$. When such gap is detected, the loop stops and the threshold value $\sigma_s$ is set (block 46) to the current singular value $\sigma_i$. In case $i=r_s$ (block 44), the lowest singular value $\sigma_i=\sigma_r$ is reached, the loop is exit and $\sigma_s$ is set (block 46) to $\sigma_r$.

In case a fixed threshold is not used (block 41), a block of T samples for all S source signals $X=[|x(\Omega_s, t=0)\rangle, \ldots, |x(\Omega_s, t=T)\rangle]$ (=matrix S×T) is investigated (block 47). The signal-to-noise ratio SNR for X is calculated (block 48) and the threshold value $\sigma_s$ is set $$\sigma_s = \frac{1}{\sqrt{SNR}}$$

(block 49).

Figure 5:
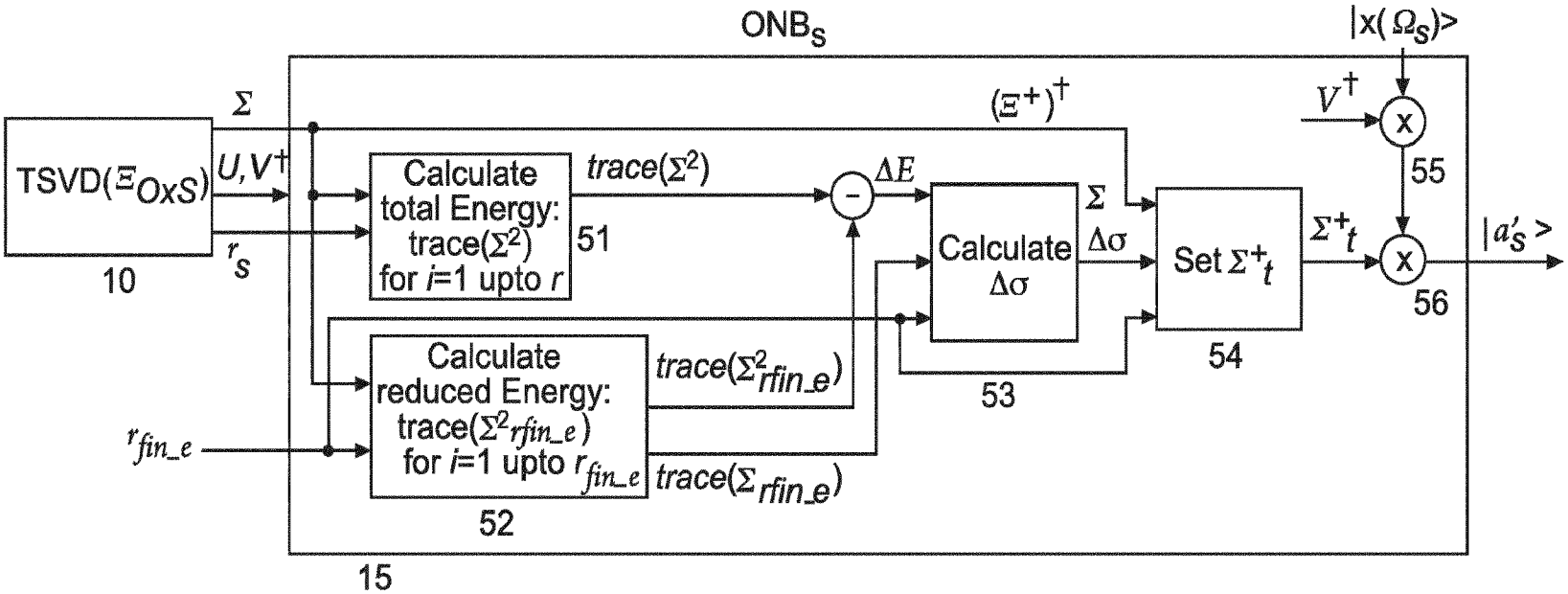
FIG. 5 is a recalculation of singular values in case of a reduced mode matrix rank $r_{fin_e}$, and computation of $|a'_s\rangle$.

FIG. 5 shows within step/stage 15, 25, 35 the recalculation of singular values in case of reduced mode matrix rank $r_{fin}$, and the computation of $|a'_s\rangle$. The encoder diagonal matrix $\Sigma_s$ from block 10/20/30 in FIG. 1/2/3 is fed to a step or stage 51 which calculates using value $r_s$ the total energy $\mathrm{trace}(\Sigma^2)=\Sigma_{i=1}^{r_s}\sigma_{s_i}^2$, to a step or stage 52 which calculates using value $r_{fin_e}$ the reduced total energy $$\mathrm{trace}(\sum_{r_{fin_e}}^{2}) = \sum_{i=1}^{r_{fin_e}} \sigma_{g_i}^2,$$

and to a step or stage 54. The difference ΔE between the total energy value and the reduced total energy value, value $$\mathrm{trace}(\sum_{r_{fin_e}})$$

and value $r_{fin_e}$ are fed to a step or stage 53 which calculates $$\Delta\sigma = \frac{1}{r_{fin_e}}\left(-\mathrm{trace}(\sum_{r_{fin_e}}) + \sqrt{\left[\mathrm{trace}(\sum_{r_{fin_e}})\right]^2 + r_{fin_e}\Delta E}\right).$$

Value Δσ is required in order to ensure that the energy which is described by $\mathrm{trace}(\Sigma^2)=\Sigma_{i=1}^{r}\sigma_{l_i}^2$ is kept such that the result makes sense physically. If at encoder or at decoder side the energy is reduced due to matrix reduction, such loss of energy is compensated for by value Δσ, which is distributed to all remaining matrix elements in an equal manner, i.e. $\Sigma_{i=1}^{r_{fin}}(\sigma_i+\Delta\sigma)^2=\Sigma_{i=1}^{r}(\sigma_i)^2$.

Step or stage 54 calculates $$\sum_{t}^{+} = \sum_{i=1}^{r_{fin_e}} \frac{1}{(\sigma_{s_i} + \Delta\sigma)} I$$

from $\Sigma_s$, Δσ and $$r_{fin_e}.$$

Input signal vector $|x(\Omega_s)\rangle$ is multiplied by matrix $V_s^\dagger$. The result multiplies $\Sigma_t^\dagger$. The latter multiplication result is ket vector $|a'_s\rangle$.

Figure 6:
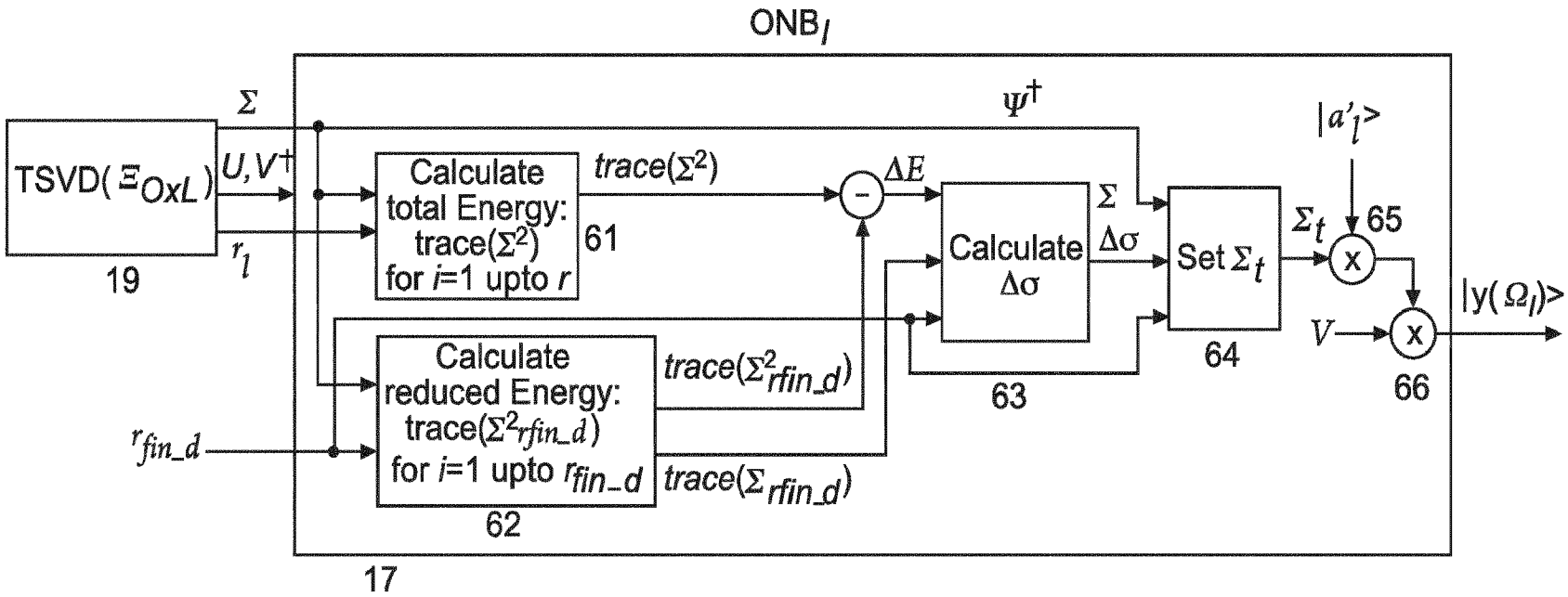
FIG. 6 is a recalculation of singular values in case of reduced mode matrix ranks and $r_{fin_e}$ and $r_{fin_d}$, computation of loudspeaker signals $|y(\Omega_l)\rangle$ with or without panning.

FIG. 6 shows within step/stage 17, 27, 37 the recalculation of singular values in case of reduced mode matrix rank $r_{fin}$, and the computation of loudspeaker signals $|y(\Omega_l)\rangle$, with or without panning. The decoder diagonal matrix $\Sigma_l$ from block 19/29/39 in FIG. 1/2/3 is fed to a step or stage 61 which calculates using value $r_l$ the total energy $\mathrm{trace}(\Sigma^2)=\Sigma_{i=1}^{r_i}\sigma_{s_i}^2$, to a step or stage 62 which calculates using value $r_{fin_d}$ the reduced total energy $$\mathrm{trace}(\sum_{r_{fin_d}}^{2}) = \sum_{i=1}^{r_{fin_d}} \sigma_{s_i}^2,$$

and to a step or stage 64. The difference ΔE between the total energy value and the reduced total energy value, value $$\mathrm{trace}(\sum_{r_{fin_d}})$$

and value $$r_{fin_d}$$

are fed to step or stage 63 which calculates $$\Delta\sigma = \frac{1}{r_{fin_d}}\left(-\mathrm{trace}(\sum_{r_{fin_d}}) + \sqrt{\left(\mathrm{trace}(\Sigma_{r_{fin_d}})\right)^2 + r_{fin_d}\Delta E}\right).$$

Step or stage 64 calculates $$\sum_t = \sum_{i=1}^{r_{fin_d}} \frac{1}{(\sigma_{l_i} + \Delta\sigma)} I$$

from $\Sigma_i$, Δσ and $$r_{fin_d}.$$

Ket vector $|a'_s\rangle$ is multiplied by matrix $\Sigma_t$. The result is multiplied by matrix V. The latter multiplication result is the ket vector $|y(\Omega_l)\rangle$ of time-dependent output signals of all loudspeakers.

The inventive processing can be carried out by a single processor or electronic circuit, or by several processors or electronic circuits operating in parallel and/or operating on different parts of the inventive processing.

The invention claimed is:

1. A method for Higher Order Ambisonics (HOA) decoding comprising:

receiving information regarding vectors describing a state of spherical harmonics for loudspeakers;

determining the vectors describing the state of spherical harmonics, wherein the vectors were determined based on a Singular Value Decomposition, and wherein the vectors are based on a matrix of information related to the vectors;

determining a resulting HOA representation of vector-based signals based on the vectors describing the state of the spherical harmonics wherein the matrix of the information related to the vectors was adapted based on direction of sound sources and wherein the matrix is based on a rank that provides a number of linear independent columns and rows related to the vectors.

2. The method of claim 1, further comprising receiving information regarding direction values ($\Omega_l$) of loudspeakers and a decoder Ambisonics order ($N_l$), and determining the vectors for loudspeakers located at directions corresponding to the direction values ($\Omega_l$) and a decoder mode matrix ($\Psi_{O\times L}$) based on the direction values ($\Omega_l$) of loudspeakers and the decoder Ambisonics order ($N_l$).

3. The method of claim 2, further comprising determining two corresponding decoder unitary matrices ($U_l^\dagger$, $V_l$) and a decoder diagonal matrix ($\Sigma_l$) containing singular values and a final rank ($r_{fin_d}$) of the decoder mode matrix ($\Psi_{O\times L}$) based on a Singular Value Decomposition of the decoder mode matrix ($W_{O\times L}$).

4. The method of claim 2, wherein vectors ($|Y(\Omega_l)\rangle$) of the spherical harmonics for the loudspeakers and the decoder mode matrix ($\Psi_{O\times L}$) are based on a corresponding panning function ($f_l$) that includes a linear operation and a mapping of the source positions in the audio input signal ($|x(\Omega_s)\rangle$) to positions of the loudspeakers in the vector ($|y(\Omega_l)\rangle$) of loudspeaker output signals.

5. An apparatus for Higher Order Ambisonics (HOA) decoding comprising:

a receiver for receiving information regarding vectors describing a state of spherical harmonics for loudspeakers;

a processor configured to determine the vectors describing the state of spherical harmonics, wherein the vectors were determined based on a Singular Value Decomposition, and wherein the vectors are based on a matrix of information related to the vectors, the processor further configured to determine a resulting HOA representation of vector-based signals based on the vectors describing the state of the spherical harmonics, wherein the matrix of the information related to the vectors was adapted based on direction of sound sources and wherein the matrix is based on a rank that provides a number of linear independent columns and rows related to the vectors.

6. The apparatus of claim 5, wherein the processor is further configured to receive information regarding direction values ($\Omega_l$) of loudspeakers and a decoder Ambisonics order ($N_l$), and to determine the vectors for loudspeakers located at directions corresponding to the direction values ($\Omega_l$) and a decoder mode matrix ($\Psi_{O\times L}$) based on the direction values ($\Omega_l$) of loudspeakers and the decoder Ambisonics order ($N_l$).

7. The apparatus of claim 5, wherein the processor is further configured to determine two corresponding decoder unitary matrices ($U_l^\dagger$, $V_l$) and a decoder diagonal matrix ($\Sigma_l$) containing singular values and a final rank ($r_{fin_d}$) of the decoder mode matrix ($\Psi_{O\times L}$) based on a Singular Value Decomposition of the decoder mode matrix ($\Psi_{O\times L}$).

8. The apparatus of claim 5, wherein vectors ($|Y(\Omega_l)\rangle$) of the spherical harmonics for the loudspeakers and the decoder mode matrix ($\Psi_{O\times L}$) are based on a corresponding panning function ($f_l$) that includes a linear operation and a mapping of the source positions in the audio input signal ($|x(\Omega_s)\rangle$) to positions of the loudspeakers in the vector ($|y(\Omega_l)\rangle$) of loudspeaker output signals.

9. Computer program product comprising instructions which, when carried out on a computer, perform the method according to claim 1.

* * * * *